United States Patent [19]

Lardon

[11] Patent Number: 4,557,485

[45] Date of Patent: Dec. 10, 1985

[54] QUESTION AND ANSWER BOARD GAME

[76] Inventor: Daniel R. Lardon, 413 Marteen St., Banff Alberta (Tol Oco), Canada

[21] Appl. No.: 657,382

[22] Filed: Oct. 3, 1984

[30] Foreign Application Priority Data

Nov. 7, 1983 [FR] France ..... 83 17661

[51] Int. Cl.[4] ..... A63F 3/00

[52] U.S. Cl. ..... 273/249

[58] Field of Search ..... 273/243, 249, 248

[56] References Cited

U.S. PATENT DOCUMENTS

| | | | |
|---|---|---|---|
| 3,104,106 | 9/1963 | Kenney et al. | 273/249 |
| 3,939,578 | 2/1976 | Coffey | 273/243 X |
| 4,124,214 | 11/1978 | Pavis | 273/249 |
| 4,201,388 | 5/1980 | Cantelon | 273/251 |
| 4,272,080 | 6/1981 | Breslin | 273/249 |
| 4,315,627 | 2/1982 | Schlegel et al. | 273/249 |

*Primary Examiner*—Richard C. Pinkham
*Assistant Examiner*—Scott L. Brown
*Attorney, Agent, or Firm*—Albert L. Jeffers

[57] ABSTRACT

Game equipment comprising a board (1) one surface of which is marked with a game track (2, 3) made up of a set of compartments ($2_1$, $3_1$) on which the players can move their pieces. Equipment characterized in that it also comprises a number of sets of cards bearing questions to which the players must reply, and answers to these questions, each set bearing a mark (A, B, C) in a given color and each compartment ($2_1$, $3_1$) being correspondingly colored, each set of cards being divided into a plurality of groups by numbered references (10, 20, 40) given points, each reproduced on a compartment.

4 Claims, 1 Drawing Figure

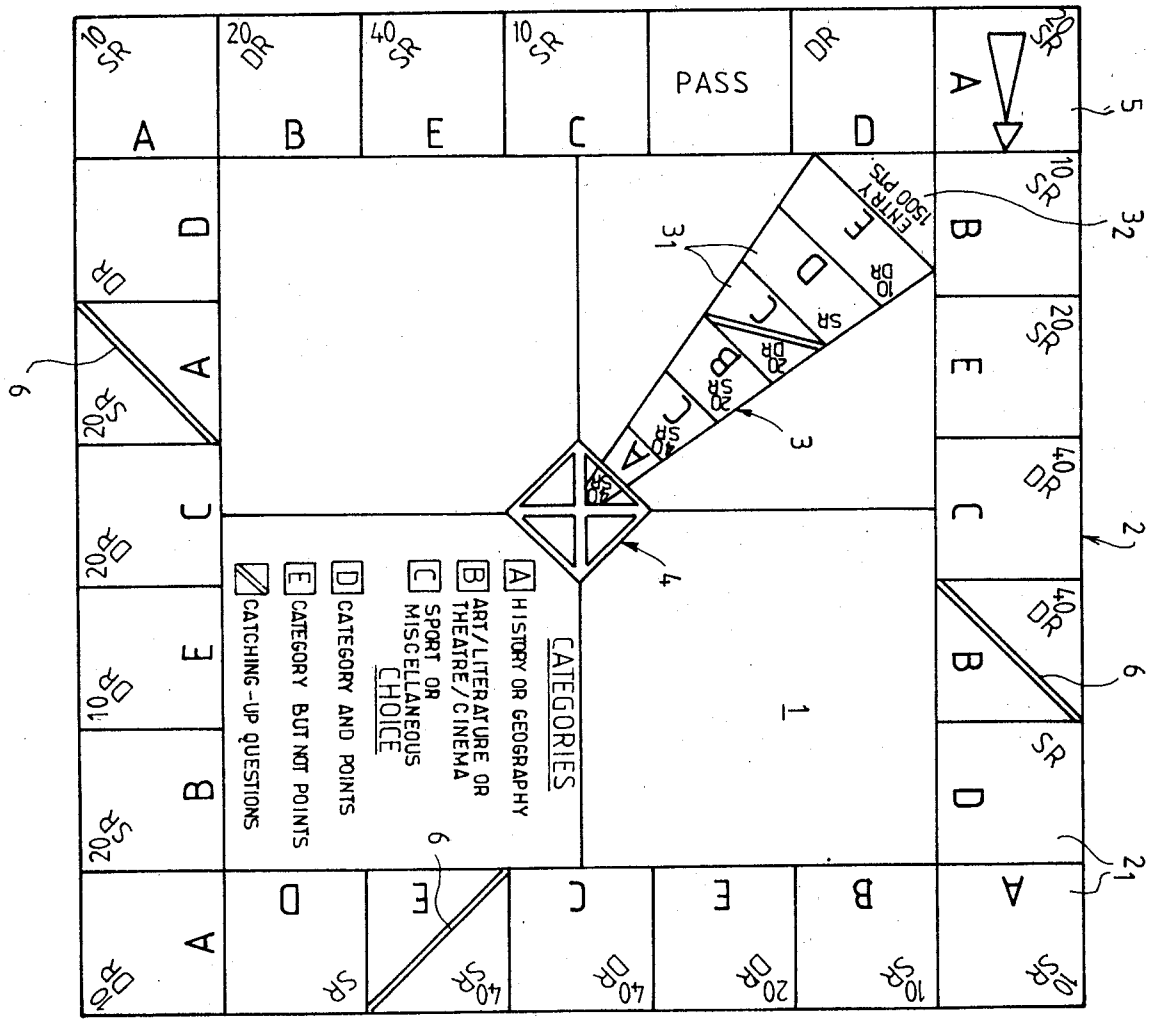
CATEGORIES
A HISTORY OR GEOGRAPHY
B ART/LITERATURE OR THEATRE/CINEMA
C SPORT OR MISCELLANEOUS
CHOICE
D CATEGORY AND POINTS
E CATEGORY BUT NOT POINTS
CATCHING-UP QUESTIONS
ENTRY 1500 PTS.
PASS
1
2
2₁
3
3₁
3₂
4
5
6

QUESTION AND ANSWER BOARD GAME

The invention relates to game equipment.

The equipment according to the invention comprises a board one surface of which is marked with a game track made up of a set of compartments on which the players can move their pieces, the number of compartments moved being determined by dice thrown in succession by each player, the equipment being characterised in that it also comprises a number of sets of cards bearing questions to which the players must reply, together with answers to these questions, each set bearing a mark in a given colour and each compartment being correspondingly coloured, the various colours being distributed at random along the compartments, each set of cards being divided into a plurality of groups by numbered reference giving points, each being reproduced in random order on a compartment so that each compartment defines a set of cards out of which the player must choose one and reply to the question put.

According to another feature, the compartments also bear a mark determining the number of wrong replies which the player can make before replying correctly.

According to another feature, some compartments bear a second mark enabling the player to choose a catching-up question if he has not correctly answered the question on the previously-chosen card.

According to another feature, the track comprises a closed track and an open track, the latter terminating at an end-of-game compartment.

By way of non-limitative example the invention is shown in the accompanying single drawing, which is a view in elevation of an embodiment of the game equipment.

The invention accordingly aims at providing equipment which, during a game, combines the luck and the knowledge of each player, i.e. equipment for an attractive, educational game.

In the accompanying drawing, the equipment comprises a wooden, cardboard or plastics board 1, the top surface of which is marked with a game track comprising a square closed track 2 and an open track 3 disposed inside track 2 and terminating at an end-of-game compartment 4.

The tracks are divided into compartments $2_1$, $3_1$ along which each player moves his pieces. Starting from an initial compartment 5, each player takes turns to move this piece a number of compartments corresponding to the number thrown by his dice.

The tracks are associated with a number of sets of cards (not shown) each bearing a question to which the player must reply, together with the answer to the question. Each set of cards is also divided into groups of cards given a number of points varying with the difficulty of the question on the card.

In the example shown, three sets of cards are each divided into three groups, the questions on the cards in each group being valued at 10 points, 20 points or 40 points.

Each set of cards is marked in colour A, B or C, e.g. red, blue or green, and compartments 2 and 3 are correspondingly coloured in an arbitrary order.

The compartments are also marked 10, 20 or 40, defining the points value of the question so that when a player's piece stops on a compartment it determines the set of cards and the group in the set from which the player must choose a card and correctly answer the question thereon to obtain a number of points corresponding to the question and continue the game.

Each set of cards corresponds to a class of question subjects, e.g. the set of cards marked in colour. A, also shown on certain compartments will contain history or geography cards, the set of cards marked in colour B will have questions on art and literature or theatre/-cinema, and the set of cards marked in colour C will have questions on sport or miscellaneous subjects.

In the example shown, the compartments are also marked "S R" or "D R", determining the number of answers which the player can give. Thus, mark S R indicates that the player can give only a single reply, whereas mark D R indicates that he can give a wrong answer before giving the right answer.

In the example shown, some compartments are coloured not A, B or C but D or E, e.g. orange or chestnut. In the case of compartments coloured D, the player may choose a question from any set of cards, so that the ease or difficulty of the question is determined by chance. In the case of E-colour compartments, the player may choose a question from any set of cards but only from the group where the difficulty of the question, depending on the number of points, is shown in the corresponding compartment.

Some compartments coloured A, B, C, D or E are also marked in the drawing by two sloping parallel lines 6. These marks indicate that the player can choose a second card from the group in the series if he has not correctly answered the question on the card chosen previously.

Accordingly, the game combines chance or luck with each player's knowledge of various subjects.

Initially, the speed of advance of each player's piece along the tracks will depend on the throw of dice. The compartment on which a player's piece has stopped will determine:

(a) the subject of the question (set of cards coloured A, B, C), the difficulty of the question (10, 20 or 40 points), the number of possible replies (single reply SR or double replay DR) and the possibility of choosing a catching-up card (mark 6), or (b) the same parameters as before except the subject and difficulty of the question (compartment coloured D), since the subject of the question (colour A, B or C) and difficulty thereof (10, 20 or 40 points) are left to the player's choice, or (c) the same parameters except that subject of the question (compartment coloured D), i.e. the player can choose a question in any series but within one group of cards for which the value of points is indicated in the corresponding compartments.

Preferably the game will be played in two stages, the first stage consisting in moving the pieces along the peripheral track 2 until the players obtain a given total number of points, e.g. 1500. After obtaining 1500 points the player will pass to the second stage of the game by moving his piece to $3_2$ at the beginning of the open track 3, so as to try to bring his piece as quickly as possible to the "arrival" compartment 4.

I claim:

1. Games equipment comprising a board one surface of which is marked with a game track made up of a set of compartments on which the players can move their pieces, the number of compartments moved being determined by dice thrown in succession by each player, also comprising a number of sets of cards bearing questions to which the players must reply, together with answers to these question, each set bearing a mark in a given colour and compartments being correspondingly coloured, the various colours being distributed at random along the compartments, each set of cards being divided into a plurality of groups by numbered references giving points, each numbered reference being reproduced in random order on a compartment so that each compartment defines a set of cards by colour and numbered reference out of which the player must choose one and reply to the question put.

2. Equipment according to claim 1, characterised in that the compartments also bear a mark determining the number of wrong replies which the player can make before replying correctly.

3. Equipment according to claim 2, characterised in that some compartments bear a second mark enabling the player to choose a catching-up question if he has not correctly answered the question on the previously-chosen card.

4. Equipment according to any of the preceding claims, characterised in that the track comprises a closed track and an open track, the latter terminating at an end-of-game compartment.

* * * * *